United States Patent [19]

Griffin

[11] 3,934,873

[45] Jan. 27, 1976

[54] BASEBALL BATTING AID

[76] Inventor: Billy J. Griffin, 3961 Scott Drive, Forest Park, Ga. 30050

[22] Filed: Apr. 29, 1974

[21] Appl. No.: 465,117

[52] U.S. Cl. ..... 273/26 E; 273/58 C; 273/95 A

[51] Int. Cl.[2] ..... A63D 15/10

[58] Field of Search ..... 273/26 E, 26 EA, 29 A, 273/184 B, 185 C, 185 D, 196, 197 R, 200 R, 200 B, 58 C, 95 A, 95 AA

[56] References Cited

UNITED STATES PATENTS

| | | | |
|---|---|---|---|
| 667,563 | 2/1901 | Oakley | 273/58 C |
| 1,682,059 | 8/1928 | Backus | 273/185 C |
| 2,081,059 | 5/1937 | Mitchell | 273/58 C |
| 2,186,016 | 1/1940 | Evans | 273/58 C |
| 2,641,933 | 6/1953 | Kinkle | 273/184 B |
| 2,944,817 | 7/1960 | Stiller | 273/58 C X |
| 3,086,775 | 4/1963 | Albert | 273/26 EA |
| 3,115,346 | 12/1963 | Pohle | 273/200 R X |
| 3,469,840 | 9/1969 | Kruzel | 273/58 C |
| 3,637,209 | 1/1972 | Raut | 273/26 E |

*Primary Examiner*—Richard C. Pinkham
*Assistant Examiner*—T. Brown
*Attorney, Agent, or Firm*—B. J. Powell

[57] ABSTRACT

A baseball batting aid for use in increasing the proficiency of a batter to hit different types of pitched balls. The aid includes a conventional cork center baseball having a diametrically extending hole of a first diameter drilled therethrough with one end thereof counterbored. A cord is received through the hole and a metal sleeve member with a backup member is inserted into a counterbore of the hole so that the knotted end of the cord can be pulled back into the counterbore of the hole. A patch covers the opening of the counterbore.

5 Claims, 15 Drawing Figures

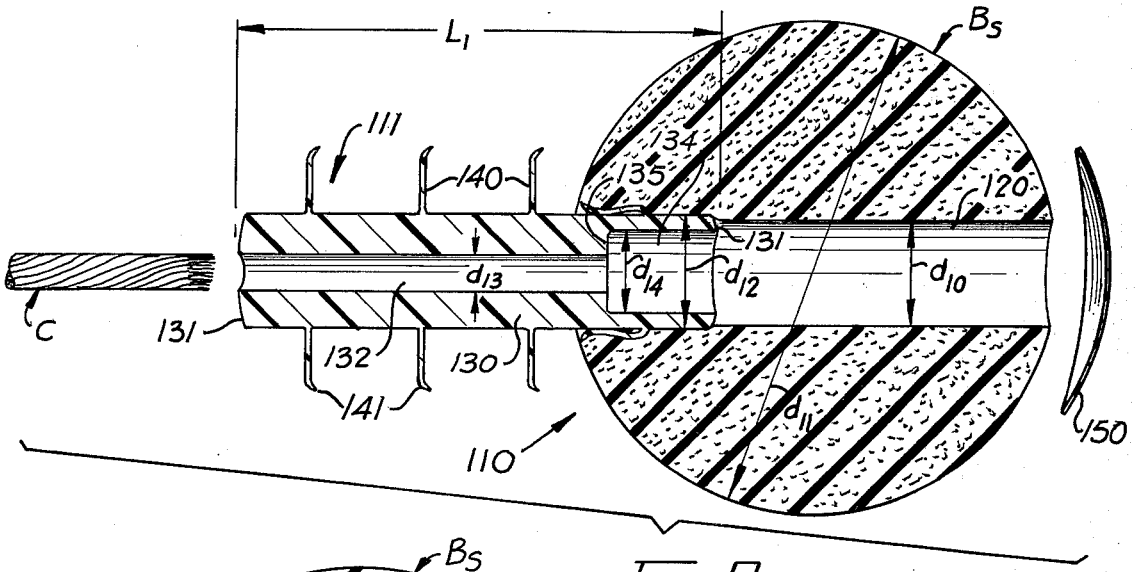
Fig 9
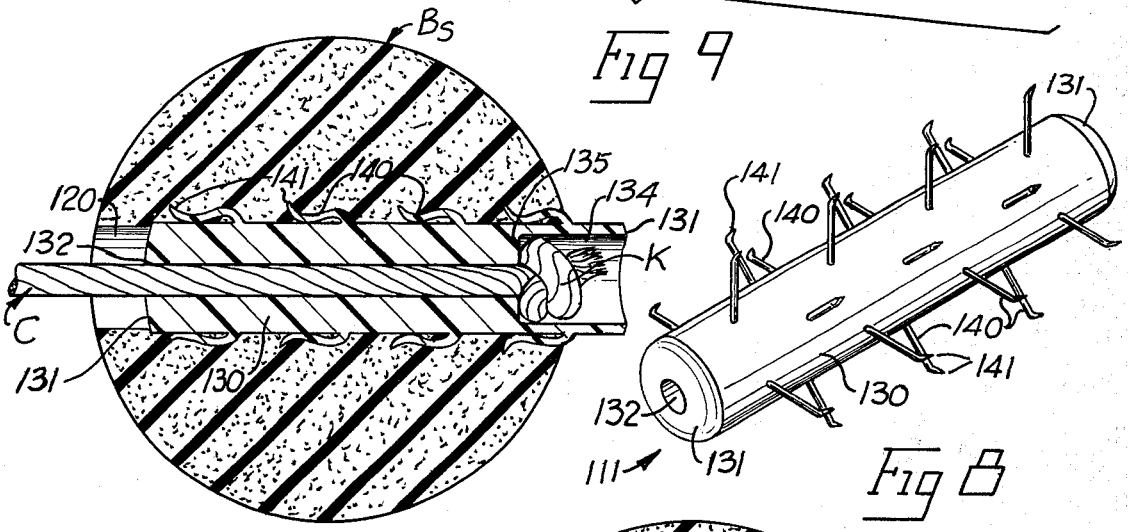
Fig 8
Fig 10
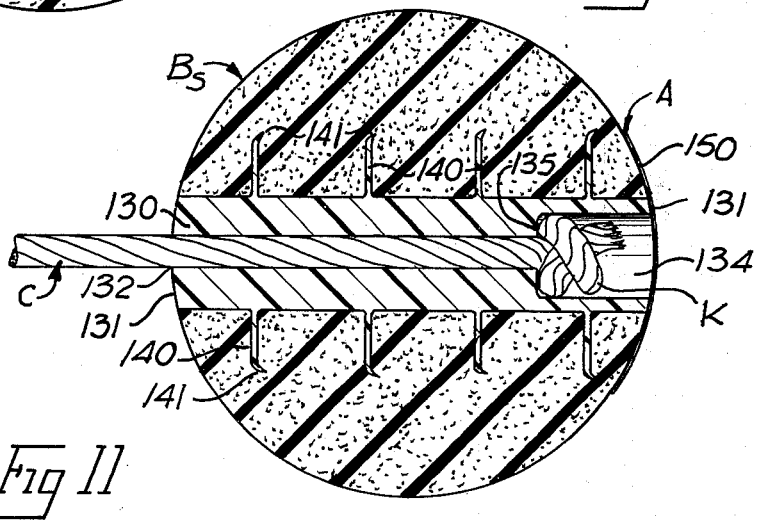
Fig 11

BASEBALL BATTING AID

BACKGROUND OF THE INVENTION

Because baseball is a popular sport, young children learn to play this sport in the organized "Pony League" and "Little League" teams. These players need to develop a proficiency at batting and such development can be achieved only by practice. Sufficient practice is difficult to achieve because of the lack of area, personnel and equipment. Batting practice devices using a baseball secured to the end of a cord have been proposed which allows the ball to be swung along a circular path by the cord so that the hitter can try to hit the ball. While such devices allow the batting practice to be accomplished in a relatively small area, difficulties have been encountered in keeping the ball secured to the cord while at the same time causing the ball to have substantially the same flight characteristics as a pitched baseball.

SUMMARY OF THE INVENTION

These and other problems and disadvantages associated with the prior art are overcome by the invention disclosed herein in that almost all types of pitches can be reproduced for batting practice as the ball is swung past the batter on the end of the cord while the connection between the ball and the cord is sufficiently strong to withstand the voilent forces encountered by the ball as it is struck. Further, the joint between the cord and ball is extremely simple and inexpensive to construct.

The apparatus of the invention includes generally a baseball with a diametrically extending hole therethrough with a counterbore at one end thereof. A cord with a knot on the end thereof is attached to the ball within the ball. A reinforcing assembly connects the knot on the cord to the ball at the shoulder between the counterbore and hole so that the knot is housed in the counterbore. A sealing patch covers the open end of the counterbore. The reinforcing assembly includes a sleeve member with a smooth passage therethrough and a head flange at one end and an annular support member positioned around the sleeve member and between the head flange and the shoulder between the hole and counterbore.

An alternate embodiment of the apparatus of the invention includes primarily a sponge rubber baseball which has an attachment therein locked into the baseball that defines a central passage therethrough with a counterbore at one end thereof. The cord extends through the attachment and is knotted so that the knot rests in the counterbore to attach the cord to the ball. A patch covers the counterbore so that the trajectory of the ball as it is swung will not be effected.

These and other features and advantages of the invention will become more apparent upon consideration of the following detailed description and accompanying drawings wherein like characters of reference designate corresponding parts throughout the several views and in which:

BRIEF DESCRIPTION OF THE DRAWINGS

FIG. 8 is a perspective view of an attachment member for a second embodiment of the invention;

FIGS. 9–11 are cross-sectional views illustrating the assembling of the invention using the attachment member of FIG. 8;

These figures and the following detailed description disclose specific embodiments of the invention, however, it is to be understood that the inventive concept may be embodied in other forms.

DETAILED DESCRIPTION OF ILLUSTRATIVE EMBODIMENTS

Figure 2:
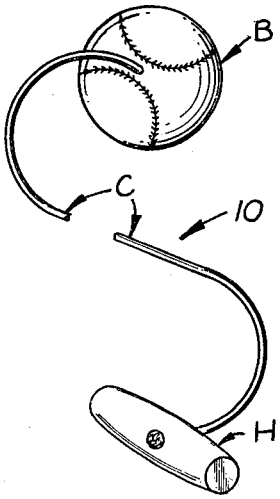
FIG. 2 is a perspective view of the invention.
Figure 1:
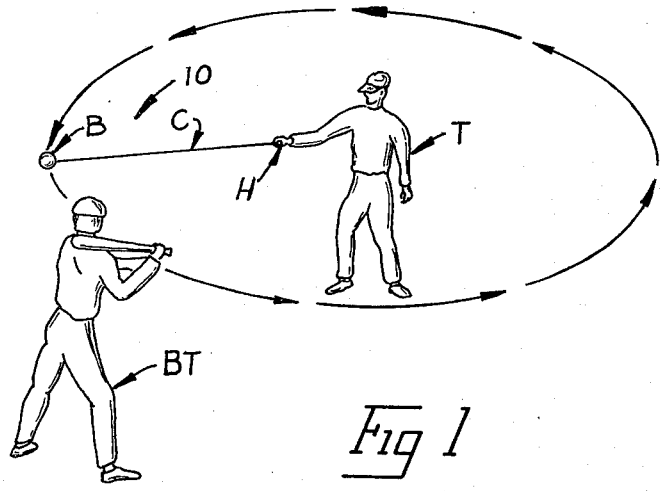
FIG. 1 is a pictorial view illustrating the invention in use.

Referring to FIGS. 1 and 2, it will be seen that the apparatus of the invention comprises generally a baseball B attached to a handle H by a cord C. The trainer T shown in FIG. 1 grasps the apparatus by the handle H and swings the baseball B about the circle illustrated by dashed lines in FIG. 1 so that a batter BT can strike the baseball as it is swung by him. Those embodiments of the invention illustrated in FIGS. 3–7 use a cork center baseball while those embodiments illustrated in FIGS. 8–15 use a sponge rubber type baseball.

Figure 3:
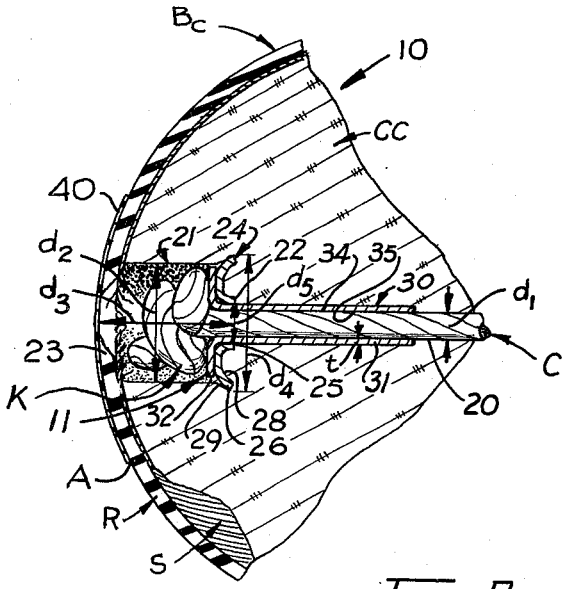
FIG. 3 is a partial cross-sectional view of the first embodiment of the invention.
Figure 4:
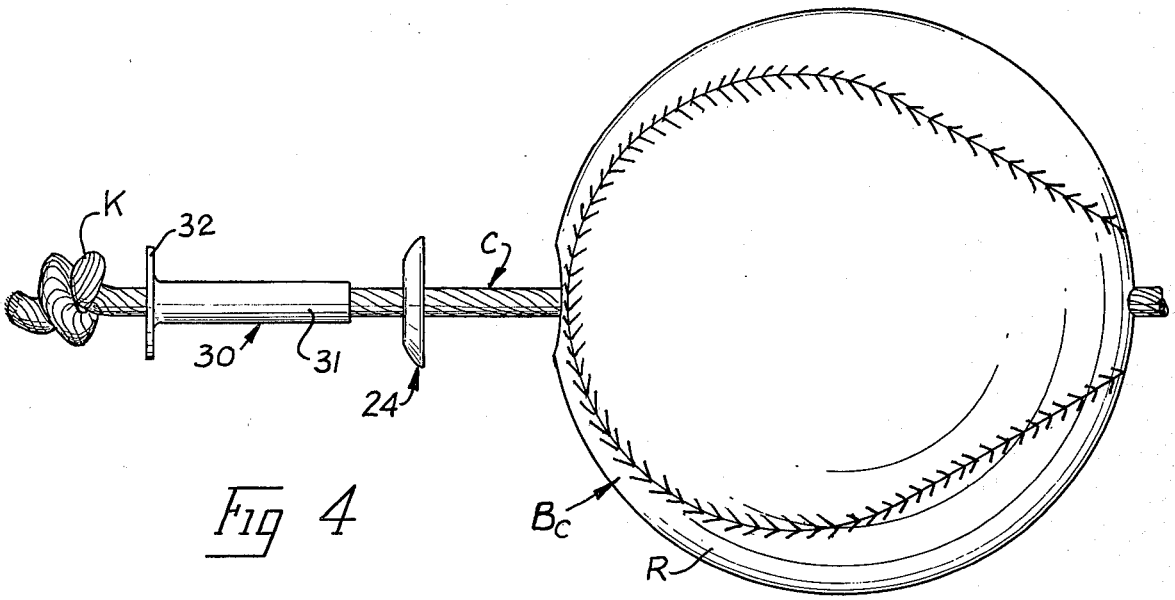
FIG. 4 is a side view of that embodiment of the invention shown in FIG. 3 being assembled.
Figure 5:
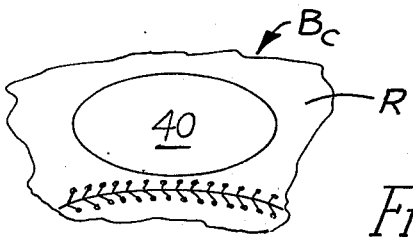
FIG. 5 is a face view of the patch used to cover the counterbore of the invention.

Referring specifically to FIGS. 3–5, it will be seen that the first embodiment of the batting aid designated 10 includes generally a baseball $B_C$ with a cord C attached thereto through a reinforcing assembly 11. The baseball $B_C$ has a spherical cork center CC with strings S wound therearound and a rubber covering R thereover. The covering R is shown as a molded rubber covering, however, the covering may be any desirable material such as leather so that the baseball $B_C$ corresponds to the actual baseball used in the particular league in which practice is necessary.

A diametrically extending hole 20 is drilled through the ball $B_C$ so that it not only extends through the cork center CC and the strings SS but also through the rubber covering R on both sides of the ball. The hole 20 has a diameter $d_1$ which is approximately the same diameter as the diameter of the cord C which is to extend through the ball. One end of the hole 20 is counterbored as indicated at 21 with the counterbore 21 having diameter $d_2$ and depth $d_3$. This forms a shoulder 22 between counterbore 21 and hole 20. It will further be noted that the rubber covering R about the counterbore 21 defines an inwardly turned lip 23 which partially covers the end of the counterbore 21.

The reinforcing assembly 11 connects the cord C with the ball $B_C$ in the hole 20 and counterbore 21. The assembly 11 includes an annular support member 24 and a sleeve member 30 received therethrough. The support member 24 is circular with an outside diameter $d_4$ slightly larger than the diameter $d_2$ of the counterbore 21 with a central aperture 25 of diameter $d_5$ therethrough. Diameter $d_5$ is slightly larger than the diameter $d_1$ of the hole 20 through the ball $B_C$ as will become more apparent. The support member 24 has an annular flange 26 of relatively constant thickness but the flange 26 is formed so that it is concave on one side at 28 and convex on the other at 29. It will thus be seen that when the support member 24 is forced into the counterbore 21, the support member 24 will force the counterbore 21 open sufficient for the support member 24 to pass therein until the support member 24 rests against and is forced into the shoulder 22 between the counterbore 21 and the hole 20 through the ball $B_C$. This locks the support member 24 into position at the shoulder 22 to provide a bearing surface against which the sleeve member 25 can be positioned. The concave side 28 of member 24 serves to captivate the shoulder 22 to assist in preventing the shoulder from deteriorating during use.

The sleeve member 30 includes a tubular section 31 with an integral head flange 32 formed at one end thereof. The tubular section 31 has a circular side wall 34 defining a central passage 35 therethrough with a diameter $d_6$ that is approximately equal to the diameter $d_1$. The side wall 34 has a thickness $t$ approximately 0.007–0.010 inch thick so that the outside diameter $d_7$ is slightly larger than the hole 20 through the ball $B_C$. The diameter $d_5$ of the opening 25 through the support member 24 is approximately the outside diameter $d_7$ of the sleeve member 25 so that the tubular section 34 will be slidably received through the passage 25 in the support member 24. The head flange 32 is oriented generally normal to the axis of the tubular portion 31 so that when the tubular portion 31 is inserted through the aperture 25 through the support member 24, the head flange 32 will rest against the support member 24 to hold it in position. Because the diameter $d_7$ of the sleeve member 30 is slightly larger than the hole 20, it will be seen that the friction between the cork center CC and the sleeve member 30 will hold the sleeve member in place. It will be seen that the cord C is knotted as indicated at K in opposition to the head flange 32 of the sleeve member 30 so that the knot K is received in the counterbore 21 and bears against the head flange 32 of the sleeve member 30. The lip 23 on the rubber covering R over the end of the counterbore 21 serves to retain the knot K in place.

The primary loading on the cord C occurs at knot K. Because the inside of sleeve member 30 is smooth, the wear that would normally be encountered is greatly reduced. Also, the sleeve member 30 is sufficiently strong to prevent the hole 20 from collapsing when the ball is hit thus increasing the life thereof. Further, any flexure of the resilient cork center CC that occurs is isolated from the cord C by the sleeve member 30 to further reduce the wear on the cord.

A sealing patch 40 is positioned over the counterbore 21 on the outside of the rubber covering R of the ball $B_C$ to cover the opening through the lip 22 of covering R. Patch 40 also serves to hold the knot K in position within the counterbore 21. The patch 40 may be attached to the covering R in any conventional manner, here shown as an adhesive A.

Referring to FIG. 4, the assembly of the embodiment shown in FIG. 3 is illustrated. The hole 20 and counterbore 21 are first made and the cord C is then pulled through the hole 20 from that side opposite the counterbore by any suitable means such as by using a wire loop. The free end of the cord C is then threaded through the aperture 25 and the support member 24 so that the concave side 28 of the support member 24 faces the ball $B_C$. This is followed by the sleeve member 30 so that the free end of the tubular section 31 faces the support member 24 and the cord C is then knotted to make the knot K. The cord C is then pulled through the ball from the off side with respect to the counterbore 21 so that the sleeve member 30 is pulled toward the support member 24 until the head flange 32 engages the convex side 29 of the support member 24. By continuing to pull the cord C, it will be seen that the tubular section 31 passes through the counterbore 21 and into the hole 20 and the support member 24 and head flange 32 will be forced into the counterbore 21 by deflecting the lip 22 on the rubber covering R about the end of the counterbore 21 so that the support member 24, head flange 32 of the sleeve member 30 and the knot K can pass into the counterbore 21. As the cord continues to be pulled, the support member 24 is forced into the shoulder between counterbore 21 and the hole 20. The patch 40 is then placed over the opening through the lip 22 in the covering R to seal the counterbore 21 and complete the structure.

Figure 6:
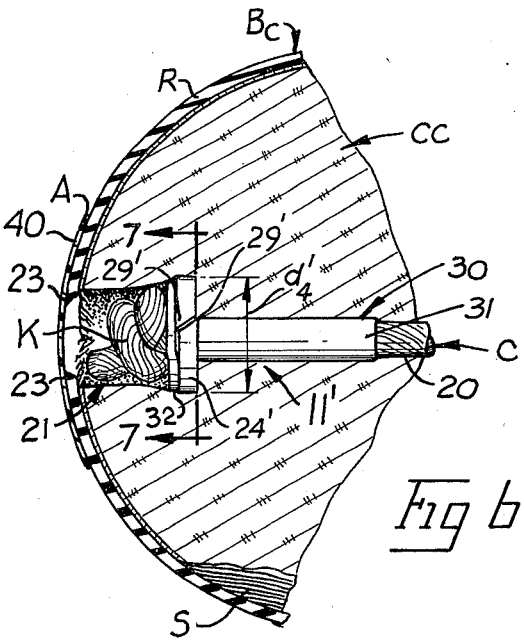
FIG. 6 is a cross-sectional view similar to FIG. 3 of a modification of the first embodiment of the invention.
Figure 7:
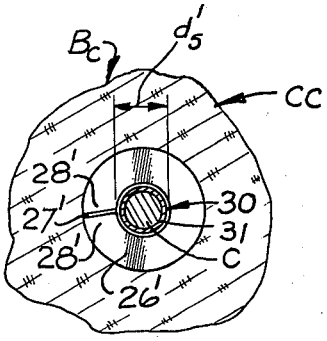
FIG. 7 is a partial cross-sectional view taken along line 7—7 in FIG. 6.

A modification of the reinforcing assembly is shown in FIGS. 6 and 7 and designated 11'. The only difference between the assembly 11' and the assembly 11 is the annular support member 24'. Support member 24' is circular with an outside diameter $d_4'$ slightly larger than diameter $d_2$ of counterbores 21 and defines a central aperture 25' therethrough of diameter $d_5'$ slightly larger than diameter $d_7$ of sleeve member 30. The support member 24' has an annular flange 26' with a generally radially extending slit 27' therethrough. The ends 28' of flange 26' adjacent slit 27' are displaced axially with respect to member 24' so that locking points 29' are provided on member 24. It will be noted that one locking point 26' engages the shoulder 22 while the other locking point 26' deforms the head flange 32 of sleeve member 30 to hold it in place. The reinforcing assembly 11' is installed similarly to assembly 11.

SECOND EMBODIMENT

Referring now to FIGS. 8–11, a second embodiment of the invention designated 110 is illustrated. The aid 110 includes generally a ball $B_S$ with a cord C attached thereto through an attachment member 111 as seen in FIG. 11.

The ball $B_S$ is relatively soft and is shown made out of a foamed elastomer. It is to be understood, however, that different soft materials may be used. The ball $B_S$ defines a diametrically extending attachment passage 120 therethrough having a prescribed diameter $d_{10}$ as best seen in FIG. 9. The ball $B_S$ is resilient as will become more apparent.

Referring to FIGS. 8–11, it will be seen that the attachment member 111 includes an elongate cylindrical main body 130 having a length $L_1$ approximately equal to the diameter $d_{11}$ of ball $B_S$ and a diameter $d_{12}$ slightly larger than the diameter $d_{10}$ of passage 120 so that the body 130 must be forced into attachment passage 120. The ends 131 of body 130 are generally semispherical in shape to correspond to the spherical shape of ball $B_S$ as will become more apparent. An axially extending cord passage 132 is defined through the body 130 with a diameter $d_{13}$ slightly less than the diameter of cord C so that cord C has a force fit with body 130. The outboard end of body 130 defines a counterbore 134 therein concentric with respect to passage 132 and having a diameter $d_{14}$ larger than diameter $d_{13}$. This defines a shoulder 135 between passage 132 and counterbore 134 within body 130.

A plurality of interconnecting spines 140 extend generally radially outward from the body 130 at circumferentially and axially spaced positions thereon. The spines 140 are relatively thin elongate members integral with body 130 and are resilient so that the spines can be forced to bend back against the side of body 130 as seen in FIG. 10 but return to a generally radially extending position when released because of their natural resiliency. A sharpened deflecting tip 141 is provided on the end of each of the spines 140 that angle toward the outboard end of body 130. Thus, when the body 130 is inserted through the ball $B_S$, outboard end first, the spines 140 are forced to bend until they are generally parallel to the exterior surface of body 130. The start of this operation is seen in FIG. 9. The body 130 is pushed through the passage 120 to the position seen in FIG. 10 so that the outwardly facing tips 141 lie at the position in passage 120 at which the bases of spines 140 are to be located upon completion of assembly. The body 130 is then pushed back through passage 120 until the ends 131 are generally flush with opposite sides of ball $B_S$. As the body 130 is pushed back through passage 120, the tips 141 pierce the ball $B_S$ and cause the spines 140 to straighten back to their radially extending positions as seen in FIG. 11. This serves to lock the member 111 within the ball $B_S$. Further, the outside of body 130 and spines 140 may be coated with an appropriate adhesive to help maintain the member 111 locked in place.

The cord C may be inserted through the cord passage 130 either before or after the installation of the member 111 in ball $B_S$. The end of cord C is first forced through passage 132 and counterbore 134 and the end knotted at K. The knot K is then pulled back into counterbore 134 so that knot K engages the shoulder 135.

A patch 150 is used to seal the open end of passage 120 and counterbore 134. The patch 150 may be attached by an adhesive A seen in FIG. 11.

Figure 13:
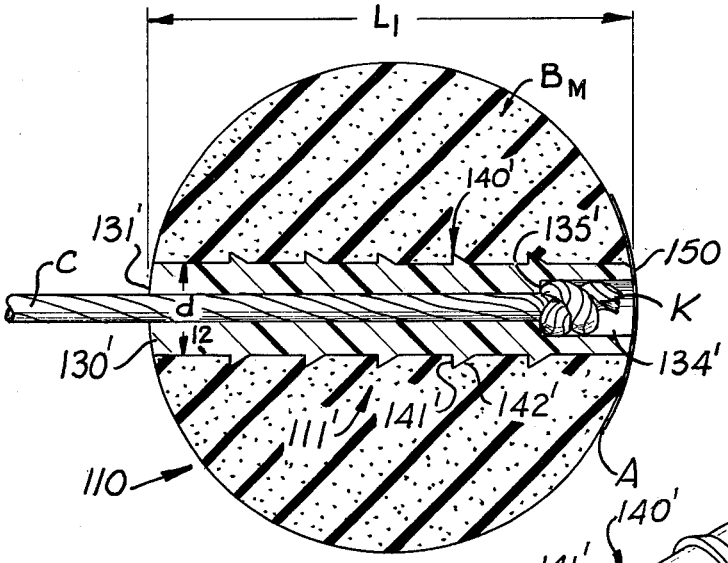
FIG. 13 is a cross-sectional view showing the attachment member of FIG. 12 in use.
Figure 12:
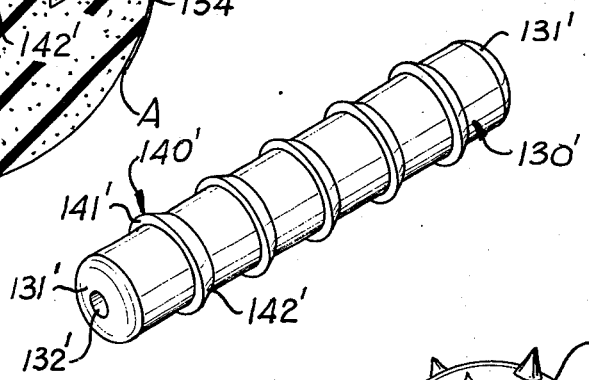
FIG. 12 is a perspective view of a modified attachment member of the second embodiment of the invention.

A modification of the attachment member is illustrated in FIGS. 12 and 13 and designated 111'. The member 111' includes an elongate cylindrical main body 130' with a length $L_1$ and a diameter $d_{12}$ similar to member 111. A cord passage 132' and counterbore 134' are provided with a knot arresting shoulder 135'. A plurality of circumferentially extending axially spaced ribs 140' are provided about body 130' to retain the attachment member 111' within ball $B_S$ as will become more apparent. Each rib 140' has a locking face 141' facing the end of member 130' opposite the counterbore 134' and a tapered face 142' facing that end of the body 130' at the counterbore 134'. The member 111' is inserted through passage 120 through ball $B_S$ with that end at counterbore 134' leading until the member 111' reaches the position seen in FIG. 13 so that the ends 131' of body 130' are flush with the ball $B_S$. The tapered faces 142' allow this to be accomplished. The locking faces 141' engage the interior of ball $B_S$ about passage 120 to prevent member 111' from being pulled back out of passage 120. A suitable adhesive may be used to assist in retaining the member 111' in place. The cord C is installed similarly to the member 111.

THIRD EMBODIMENT

Figure 14:
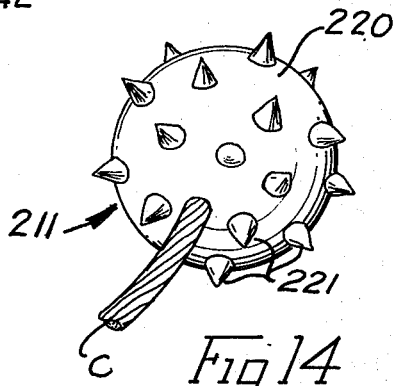
FIG. 14 is a perspective view of an attachment member for a third embodiment of the invention; and, FIG. 15 is a cross-sectional view showing the attachment member of FIG. 14 in use.
Figure 15:
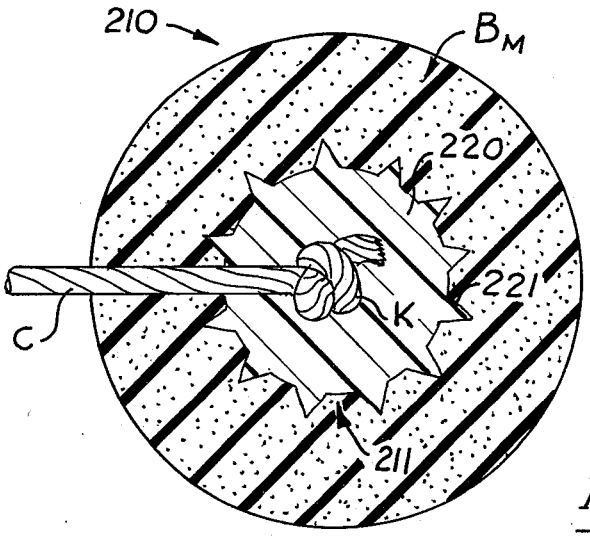

A third embodiment of the invention is illustrated in FIGS. 14 and 15 and is designated 210. The aid 210 includes a ball $B_M$ which has been molded around an attachment anchor 211 which in turn has been molded around a knot K on the end of cord C.

The attachment anchor 211 has a main body 220 and a plurality of outwardly extending protrusions 221 spaced about body 220. The body 220 may be molded from different materials and in different shapes, however, the body 220 shown is spherical and is made of a thermosetting plastic. The body 220 and protrusions 221 are made by placing the knot K on the end of cord C within a mold and then the anchor 221 molded or cast therearound.

The anchor 211 is then removed with the cord C attached and positioned in another mold where ball $B_M$ is molded thereonto. While various materials may be used, a foamed elastomer is illustrated.

While specific embodiments of the invention have been disclosed herein, it is to be understood that full use of modifications, substitutions and equivalents may be made without departing from the scope of the invention.

I claim:

1. A baseball batting aid comprising:

a ball having a diametrically extending hole therethrough, one end of said hole having a counterbore of a prescribed depth communicating with the exterior of said ball, said ball having a shoulder between said hole and said counterbore;

a cord extending through said hole and into said counterbore, said cord having a knot thereon within said counterbore, said knot having a larger dimension than the diameter of said hole;

a sleeve member comprising a tubular section positioned within said hole around said cord, and an annular head flange integral with that end of said tubular section at said counterbore, said head flange extending over said shoulder and positioned between said knot and said shoulder within said counterbore; and, an annular support member received around said tubular section of said sleeve member and juxtaposed between said head flange of said sleeve member and said shoulder, said support member having an outside diameter larger than the diameter of said counterbore and said ball being resilient about said counterbore so that said counterbore is expanded as said support member is pulled into said counterbore and then contracts as said support member is seated against said shoulder to lock said support member within said counterbore.

2. The baseball batting aid of claim 1 wherein said annular support member is concave on one side and convex on the opposite side, said concave side facing said shoulder and said convex side facing said annular head flange.

3. The baseball batting aid of claim 2 wherein said ball has a resilient core and an elastomeric covering, said counterbore extending through said covering into said core and said covering defining a resilient lip partially closing said counterbore to retain said knot within said counterbore.

4. The baseball batting aid of claim 3 further including a sealing patch positioned over the end of said counterbore at said exterior of said ball, and adhesive means connecting said patch to said ball.

5. The baseball batting aid of claim 1 wherein said annular support member defines a slot through one side thereof, said support member internally stressed to cause said member on one side of said slot to be displaced axially with respect to said support member on the other side of said slot.

* * * * *